US005088158A

United States Patent [19]

Burkholder

[11] Patent Number: 5,088,158

[45] Date of Patent: Feb. 18, 1992

[54] RESTRAINING APPARATUS AND METHOD

[76] Inventor: Gary D. Burkholder, 15671 SW. 85th Terr., Miami, Fla. 33193

[21] Appl. No.: 494,729

[22] Filed: Mar. 15, 1990

[51] Int. Cl.[5] ..... E05B 75/00; B65D 63/00

[52] U.S. Cl. ..... 24/16 PB; 70/16; 128/879

[58] Field of Search ..... 24/16 PB, 17 AP, 30.5 P; 292/307; 70/16; 248/74.3; 128/878, 879

[56] References Cited

U.S. PATENT DOCUMENTS

| | | | |
|---|---|---|---|
| 2,936,980 | 5/1960 | Rapata | 24/16 PB |
| 3,654,669 | 4/1972 | Fulton | 24/16 PB |
| 4,665,588 | 5/1987 | Nakano | 24/16 PB |
| 4,817,901 | 4/1989 | Kuo | 248/74.3 |
| 4,882,813 | 11/1989 | Nakamura | 24/16 PB |
| 4,910,831 | 3/1990 | Bingold | 24/16 PB |
| 4,964,419 | 10/1990 | Karriker | 128/879 |

*Primary Examiner*—Victor N. Sakran
*Attorney, Agent, or Firm*—Warren L. Franz

[57] ABSTRACT

A restraining method employs apparatus that has a body portion and two, laterally-spaced, downwardly extending flexible straps that can be looped around in opposite directions to be lockingly received by a toothed ratcheting mechanism in corresponding laterally-spaced openings of the body portion. An upwardly extending tab has an opening through which a rope can be strung to link together several restrained prisoners. Strap teeth and tab are located in limb noncontacting positions. The straps bend double about self-hinges with free ends fitting within non-ratcheted loops for pocket storage.

12 Claims, 2 Drawing Sheets

RESTRAINING APPARATUS AND METHOD

The present invention relates generally to a restraining apparatus similar to handcuffs; and, more particularly, to an inexpensive, easily carried, easily concealed and easily used restraining apparatus and method of restraint employing the same.

BACKGROUND OF THE INVENTION

Metal handcuffs are expensive to purchase, somewhat cumbersome to use, difficult to carry and they are difficult to conceal. Because of this problem with conventional metal handcuffs, restraining devices similar to that shown in U.S. Pat. No. 4,138,770 to Barrette et al. have been used as a restraining device by placing one of the devices around each wrist of a person to be restrained and another such device is looped through the other two loops extending around the wrists. One of the problems with using the Barrette et al. device is that an officer must have help from another officer or from the person being restrained.

U.S. Pat. No. 4,071,023 to Gregory uses a nylon or plastic restraining device which has two loop forming sections which are formed together in one piece. A problem with this device is that it is not easily stored because it does not fold flat and there is no convenient way to tie one prisoner's restraining device to another's or to a stationary object.

Accordingly, there exists the need for a restraining apparatus which is inexpensive, which is easily carried, concealed and used by one person. There is also a need for a restraining device which is less likely to injure wrists and ankles while at the same time being more universal in providing a greater allowance for varying sizes of wrists and ankles.

SUMMARY OF THE INVENTION

The present invention relates to a restraining apparatus, including a body portion having a first flexible arm with one end attached to a lower end of the body portion, the first arm extending outwardly and downwardly from the body portion. A second similar arm is provided laterally-spaced from the first arm and likewise having one end attached to the lower end of the body portion, the second arm extending outwardly and downwardly from the body portion parallel to the first arm. A first adjustable locking member is disposed on the body portion above the first arm, for receiving and locking a free end of the first arm thereto when it is looped around and pushed into such locking mechanism. A second locking mechanism is disposed, laterally-spaced from the first locking mechanism, on the body portion above the second arm, for receiving and locking a free end of the second arm to the body portion when the second arm is looped around and pushed into the second adjustable locking mechanism.

An object of the present invention is to provide an improved restraining apparatus for use by law enforcement officers.

Another object of the present invention is to provide a restraining apparatus which is extremely universal to accommodate varying sizes of wrists and ankles.

Another object of the present invention is to provide a restraining apparatus which is inexpensive to make and easy and dependable to use.

A further object of the present invention is to provide a restraining apparatus which is easily concealed and easily carried by a law enforcement officer.

A still further object of the present invention is to provide a restraining apparatus which has a connector which is easily connected to a rope for interconnecting several persons being restrained by such restraining devices or, alternatively, such attachment structures can be utilized to store on wall hooks or the like for immediate retrieval.

Other objects, advantages and novel features of the present invention will become apparent from the following detailed description of the invention when considered in conjunction with the accompanying drawings.

BRIEF DESCRIPTION OF THE DRAWINGS

Embodiments of the invention have been chosen for purposes of description and illustration, and are shown in the accompanying drawings, wherein.

Like elements are referred to by like reference numerals

DETAILED DESCRIPTION OF THE PREFERRED EMBODIMENT

Figure 1:
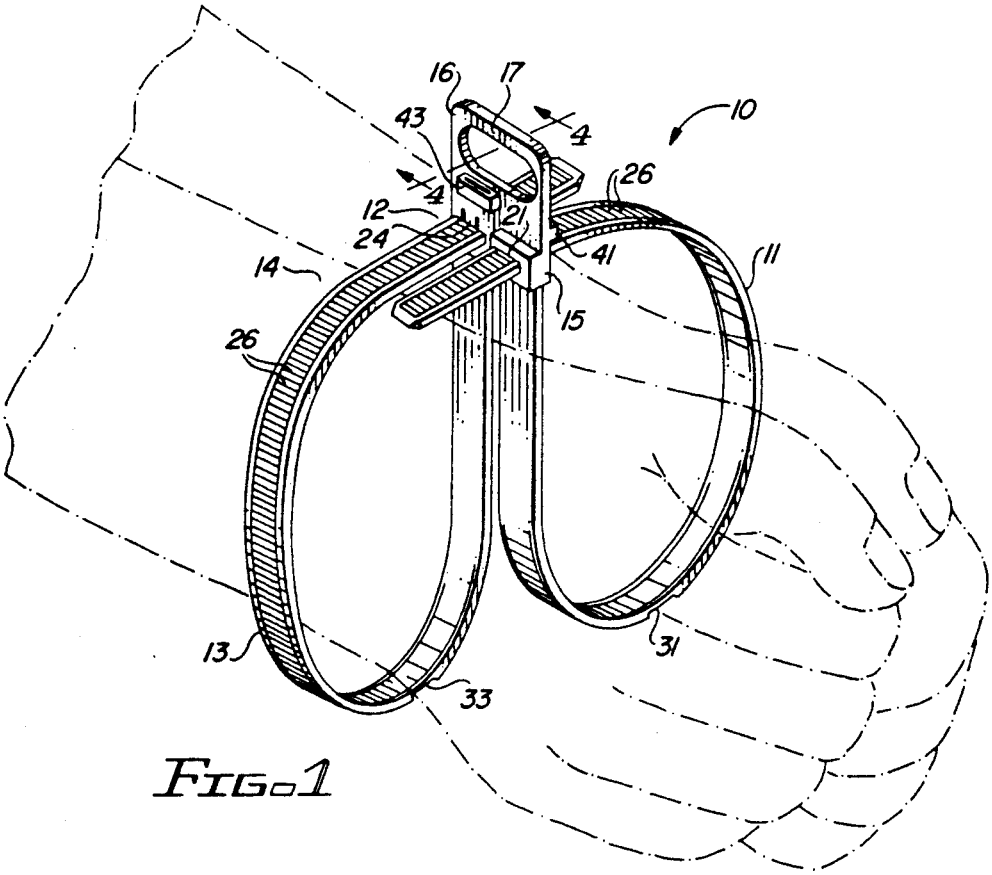
FIG. 1 is a perspective view of a preferred embodiment of the apparatus of the present invention usable in the method of the invention as handcuffs, extending around wrists of a human being shown in dashed lines.

As shown in FIG. 1, a restraining apparatus in the form of handcuffs 10, in accordance with the present invention, has one flexible arm 11 extending around a right wrist 12 and another flexible arm 13 extending around a left wrist 14 of a person to be restrained.

The arms 11, 13 extend longitudinally outwardly and downwardly from laterally-spaced positions along a lower end edge of a body portion 15. A tab 16 having an attachment hole 17 therein is located at an upper end of the body portion 15.

Figure 2:
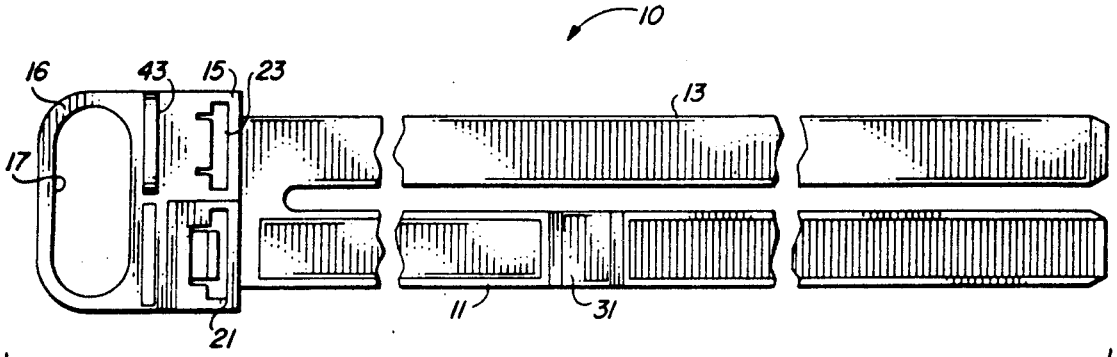
FIG. 2 is front view of the embodiment of FIG. 1 shown substantially in a flat position.
Figure 3:
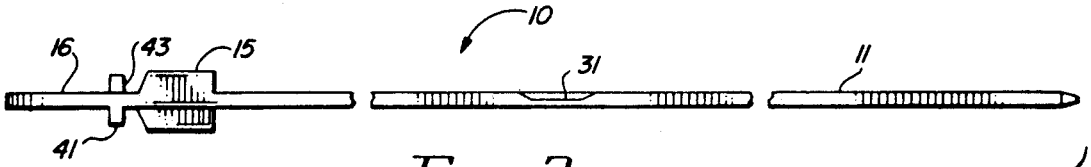
FIG. 3 is a side view of the apparatus shown in FIG. 2 taken along line 4—4 of FIG. 3.

In order to use the restraining device 10, it is merely placed with the arms 11 and 13 extending downwardly between the wrists 12 and 14, and the tab 16 extending upwardly. The flexible arm 11 is then looped around the right wrist 12 and into an attachment opening 21 (FIG. 2) until it is snug. The arm 13 is grasped and looped around the left wrist 14 and into the opening 23. Each arm 11, 13 may take the form of a nylon strap and retention of the strap in the opening 21, 23 can be accomplished by ratchet means.

Figure 4:
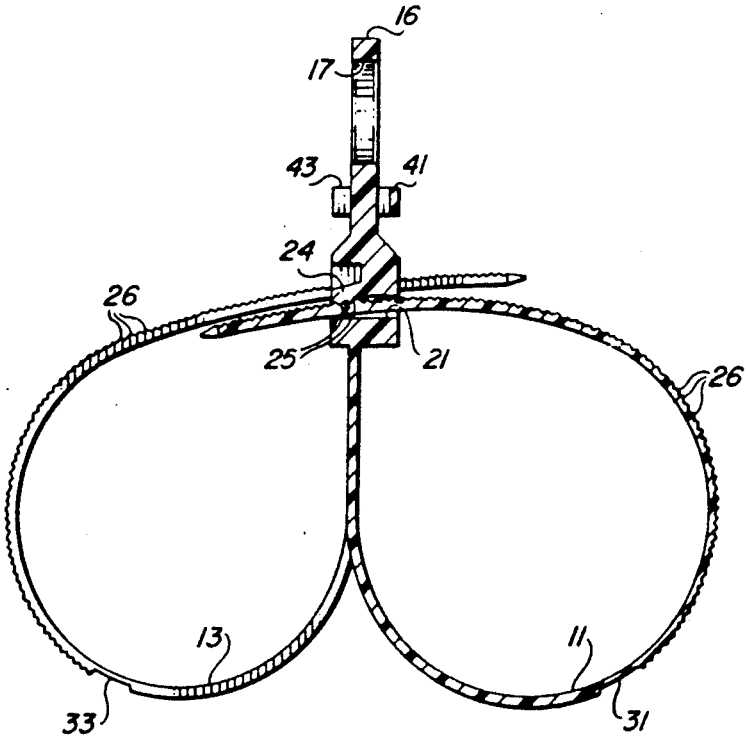
FIG. 4 is section view taken along the line 4—4 of FIG. 1.

Referring to FIG. 4, a ratchet member 24 having teeth 25 is biased in the downward direction on body portion 15 to interact with corresponding teeth 26 on the straps 11, 13. The arrangement is similar to that used to lock a free end of a flexible strap in an opening of known cable ties and the like which have a single strap which tightens around a coiled cable. It will be understood that both of the openings 21 and 23 have such structures as shown in FIG. 4 therein, so that when the strap 11, 13 is inserted into the respective opening 21, 23, the ratchet lock 24 will be pushed downwardly but will bounce along against the teeth 26 on the flexible strap 21, 23. However, when it is desired to withdraw the strap 11, 13 by pulling it in the opposite direction out of the opening 21, 23, interaction of the ratchet teeth 25, 26 will prevent its withdrawal unless the ratchet member 24 is forced upwardly against the downward bias, such as by means of a screwdriver or the like inserted between the teeth 25, 26. Other ratchet arrangements, such as that shown in U.S. Pat. No. 4,138,770, can also be used. It is noted that for avoidance of injury, teeth 26 are disposed only on those parts of the arms 11, 12 that will be outside the loops formed when applied as shown in FIG. 1. No teeth are disposed on either side of the parts of the straps 11, 13 that extend between the wrists, and teeth are formed only on the external sides of the nonadjacent parts that are directed back on themselves toward the openings 21, 23 to form the loops. It is also noted that a rear view of the strap 11 and opening 21, will appear identical to the shown front view of the strap 13 and opening 23; and vice versa.

Figure 5:
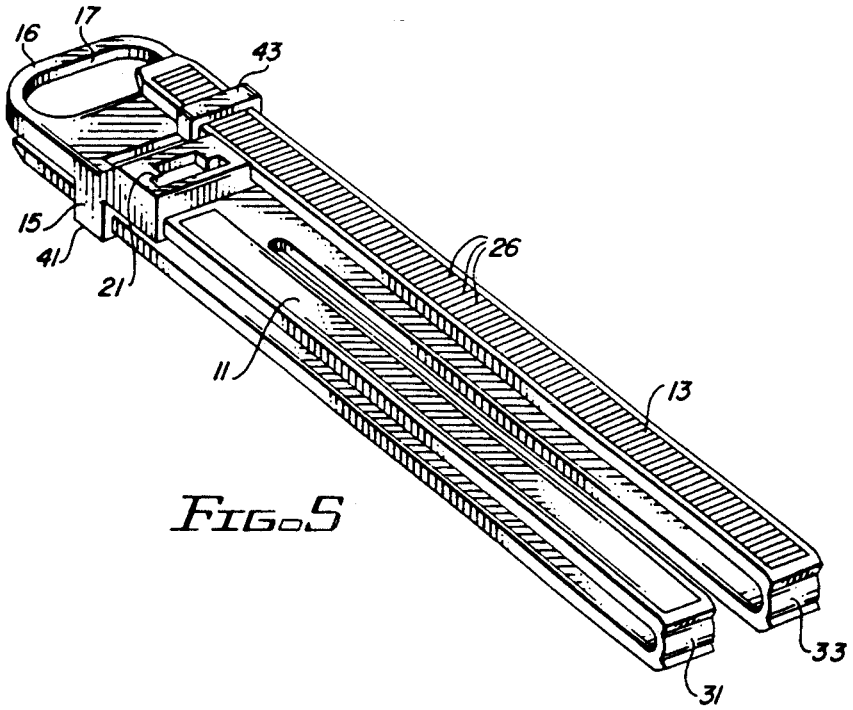
FIG. 5 a perspective view of the embodiment of FIGS. 1–4 shown in a folded, storage position.

FIG. 5 shows the embodiment 10 of the present invention in a storage position with the straps 11, 13 folded at integral hinged portions 31, 33 constructed by reducing the thickness of the straps 11, 13 at locations midway between the ends. The free end of the strap 11 extends through a loop or securing ring 41 attached to the body 15 and located above the lock entry 21. The free end of the strap 13 extends through a loop 43 connected to the body 15. Folding in this manner forms a very compact structure which can easily be placed in a shirt, jacket or trouser pocket of a standard issue police or military uniform. It will be appreciated that large quantities can be stored in a very small space, and they also can be stored on hooks or nails through the holes 17.

The dual strap restraining device 10 is preferably formed of nylon plastic with a tensile strength of 300 pounds or more. The restraining device 10 is also preferably formed as a one-piece, integral unit.

The attaching opening 17 in tab 16 permits the user to connect several prisoners together by placing a rope or the like through the opening 17 or to even connect the person being restrained to some other object. The device 10 can, for example, be used also as a leg shackle with several prisoners connected together by joining the loops formed by the openings 17. Also, where a person being restrained has missing arms of legs, the remaining extremity can be secured to a belt, other extremity or other items such as to an automobile or the like. Positioning the tab 16 and opening 17 away from the straps 11, 13 and the locking mechanisms 24 permits manually grabbing the tab 16 or connecting the respective tabs 16 of several units 10, without injuring the prisoner.

Using dual straps, so that one strap is applied to each wrist or ankle, shortens the handcuff to approximately one-half the length of traditional one strap flexible handcuffs. All surface edges are preferably rounded to avoid cuts, and strap surfaces that wrap around the wrist or ankle are smooth to avoid locking cuts. Each strap preferably has an internal circumference that exceeds standard steel handcuffs by about two inches, allowing for a broader range of wrist/ankle sizes.

It will be appreciated that the foregoing description is presented by way of example only and that modifications and variations of the presented embodiments are possible, which are within the scope of the appended claims.

What is claimed is:

1. Apparatus for restraining the wrists or ankles of a person, comprising:

a body portion having upper and lower ends, opposite sides, first and second laterally-spaced apertures extending between said sides, and first and second laterally-spaced loops located on said sides in respective alignment with said apertures;

a first flexible arm normally extending longitudinally outwardly and downwardly from said body portion and having an end attached below said first aperture to said body portion lower end, and a free end; said first arm being dimensioned, configured and adapted to be looped back on itself around one wrist or ankle to a position with said first arm free end inserted through said first aperture from one to the other of said body portion side; and said first arm being further dimensioned, configured and adapted to be folded about a midpoint, upwardly back on itself, to a position with said first arm free end inserted through said first loop from said lower to said upper body portion end;

a second flexible arm normally extending longitudinally outwardly and downwardly from said body portion, laterally spaced from said first arm, and having an end attached below said second aperture to said body portion lower end, and a free end; said second arm being dimensioned, configured and adapted to be looped back on itself around the other wrist or ankle to a position with said second arm free end inserted through said second aperture from said other to said one body portion side; and said second arm being further dimensioned, configured and adapted to be folded about a midpoint, upwardly back on itself, to a position with said second arm free end inserted through said second loop from said lower to said upper body portion end;

first means for adjustably locking said first arm in said first arm looped back position; and second means for adjustably locking said second arm in said second arm looped back position.

2. The apparatus of claim 1, wherein said first locking means comprises first ratchet means having at least one tooth located within said first aperture, a first plurality of teeth located on said first arm in positions to interact with said first aperture tooth when said first arm free end is brought through said first aperture, and means for biasing said first aperture tooth against at least one of said first arm teeth to prevent withdrawal of said first arm free end from said first aperture; and wherein said second locking means comprises second ratchet means having at least one tooth located within said second aperture, a second plurality of teeth located on said second arm in positions to interact with said second aperture tooth when said second arm free end is brought through said second aperture, and means for biasing said second aperture tooth against at least one of said second arm teeth to prevent withdrawal of said second arm free end from said second aperture.

3. The apparatus of claim 2, wherein said first and second aperture teeth are located proximate said body portion upper end respectively within said first and second apertures; said first and second arms each have opposite sides corresponding to the opposite sides of said body portion when said arms are in said normally longitudinally extending positions; said first arm teeth are located on said first arm side corresponding to said other body portion side; and said second arm teeth are located on said second arm side corresponding to said one body portion side.

4. The apparatus of claim 3, wherein said first and second arm teeth are respectively located only between said midpoints and said free ends of said arms, and said arms are smooth except at said arm teeth.

5. The apparatus of claim 1, wherein said arms are respectively formed with integral hinged portions located at said midpoints.

6. The apparatus of claim 5, wherein said apparatus comprises a unitary member and said hinged portions are constructed by reducing a dimension between said sides of said arms at said midpoints.

7. The apparatus of claim 1, wherein said body portion further comprises a tab located at said upper end and having an opening extending between said sides, said opening being dimensioned, configured and adapted to permit manual grabbing of said tab.

8. Apparatus for restraining the wrists or ankles of a person, comprising:

a body portion having upper and lower ends, opposite sides, first and second laterally-spaced apertures extending between said sides adjacent said lower end; a tab located at said upper end and having an opening between said sides, said opening being dimensioned, configured and adapted to permit manual grabbing of said tab; and first and second laterally-spaced loops located on said sides in respective alignment with and displaced from said apertures;

a first flexible arm normally extending longitudinally outwardly and downwardly from said body portion and having sides corresponding to the sides of said body portion, an end attached below said first aperture to said body portion lower end, a free end, and a midpoint including a hinged portion; said first arm being dimensioned, configured and adapted to be looped back on itself around one wrist or ankle to a position with said first arm free end inserted through said first aperture from one to the other of said body portion side; and said first arm being further dimensioned, configured and adapted to be folded about said first arm hinged portion, upwardly back on itself, to a position with said first arm free end inserted through said first loop from said lower to said upper body portion end;

a second flexible arm normally extending longitudinally outwardly and downwardly from said body portion, laterally spaced from said first arm, and having sides corresponding to the sides of said body portion, an end attached below said second aperture to said body portion lower end, a free end, and a midpoint including a hinged portion; said second arm being dimensioned, configured and adapted to be looped back on itself around the other wrist or ankle to a position with said second arm free end inserted through said second aperture from said other to said one body portion side; and said second arm being further dimensioned, configured and adapted to be folded about said second arm hinged portion, upwardly back on itself, to a position with said second arm free end inserted through said second loop from said lower to said upper body portion end;

first ratchet means for adjustably locking said first arm in said first arm looped back position to prevent withdrawal of said first arm free end from said first aperture; and second ratchet means for adjustably locking said second arm in said second arm looped back position to prevent withdrawal of said second arm free end from said second aperture.

9. A method for restraining the wrists or ankles of a person, comprising the steps of:

(a) providing an integral member including a body portion having upper and lower ends, opposite sides, first and second laterally-spaced apertures extending between said sides, and first and second loops located on said sides in respective alignment with said apertures; first and second flexible arms having free ends and extending longitudinally outwardly and downwardly from said body portion lower end in respective laterally-space positions below said first and second apertures; and ratchet mean for preventing withdrawal of said first and second arm free ends from said first and second apertures when said free ends are respectively inserted from different ones of said sides through said apertures;

(b) folding said first and second arms flat about midpoints and inserting said first and second arm free ends respectively through said first and second loops to maintain said arms in said folded flat positions;

(c) placing said member with said arms extending between said wrists or ankles;

(d) looping said first arm back on itself around one wrist or ankle, and inserting said first arm free end into said first aperture from one side of said body portion to engage said ratchet means and restrain the one wrist or ankle; and (e) looping said second arm back on itself around the other wrist or ankle, and inserting said second arm free end into said second aperture from the other side of said body portion to engage said ratchet means and restrain the other wrist or ankle.

10. The method as in claim 9, wherein in step (a) said arms include integral hinged portions located at said midpoints, and wherein in step (b) said arms are folded flat utilizing said hinged portions.

11. The method as in claim 9, wherein in step (a) said member ratchet means comprises teeth disposed on said arms so that the teeth are located after steps (c)–(e) on portions of the arms not in contact with the wrists or ankles.

12. The method as in claim 9, wherein in step (a) said body portion further comprises a tab including an opening extending between said body portion sides, and said method further comprises the step of, after steps (c)–(e), connecting the restrained person to some object by means of said opening.

* * * * *